US007634903B2

(12) United States Patent
Phillips

(10) Patent No.: US 7,634,903 B2
(45) Date of Patent: Dec. 22, 2009

(54) ION IMPULSE ENGINE

(76) Inventor: Richard Cary Phillips, 5458 Somersby Pkwy., Pinson, AL (US) 35126

( * ) Notice: Subject to any disclaimer, the term of this patent is extended or adjusted under 35 U.S.C. 154(b) by 624 days.

(21) Appl. No.: 11/247,087

(22) Filed: Oct. 12, 2005

(65) Prior Publication Data

US 2007/0079595 A1 Apr. 12, 2007

(51) Int. Cl.
*F03H 1/00* (2006.01)
*B63H 11/00* (2006.01)

(52) U.S. Cl. ..... 60/202; 60/204

(58) Field of Classification Search ..... 60/202, 60/204

See application file for complete search history.

(56) References Cited

U.S. PATENT DOCUMENTS 2,952,970 A * 9/1960 Blackman ..... 60/202
3,050,652 A * 8/1962 Baldwin ..... 313/359.1
3,052,088 A * 9/1962 Davis et al. ..... 60/202
3,156,090 A * 11/1964 Kaufman ..... 60/202
3,304,718 A * 2/1967 Webb ..... 60/202
3,501,376 A * 3/1970 Dow et al. ..... 376/144
3,535,586 A * 10/1970 Sabol ..... 315/111.61
5,005,361 A * 4/1991 Phillips ..... 60/671
7,096,660 B2 * 8/2006 Keady ..... 60/203.1
2005/0257515 A1 * 11/2005 Song ..... 60/202

* cited by examiner

*Primary Examiner*—Michael Cuff
*Assistant Examiner*—Gerald L Sung

(57) ABSTRACT

An ion engine which produces thrust by charging a propellant vapor in an electric field and then reversing the polarity of the electric field. The electric field forces the charged nuclei close to the unenergized electrode. When the electrode is energized as a positive electrical charge, the nuclei repel and create thrust in the opposite direction.

4 Claims, 4 Drawing Sheets

*ENLARGED VIEW OF BOTTOM OF ENGINE*

PLAN VIEW

SEC. A–A (REF. THIS DWG)

SEC. B–B (REF. FIG.1)

ENLARGED VIEW OF BOTTOM OF ENGINE

DIAGRAMMATIC PROCESS OF LIFT GENERATED ON CRAFT

ION IMPULSE ENGINE

This application uses concepts from U.S. Pat. No. 5,005,361 issued on Apr. 9, 1991, to Richard C. Phillips to a new, useful, and different purpose.

The government has not sponsored any research or development monies of other aids in regard to this application.

BACKGROUND OF THE INVENTION a. Technical Field

Drawn to a liquid/vapor ion power plant.

b. Description of The Prior Art

Currently there are very few useful applications of ions to generate thrust. Current methods produce very low thrust. The Phillips '361 patent uses ions to generate a rotating shaft with a turbine. The present invention eliminates the turbine and associated structure and uses the pure thrust generated by the ions to propel the engine. This reduces the mechanical loss inherent in transferring the thrust to the turbine and provides a superior method of propulsion for airborne, waterborne, or space traveling craft. The improved product significantly improves upon the existing state of the art and advances the use of ions to produce an engine to a practical, economical reality.

In addition to improving the ion to a propulsion engine, the present invention utilizes a very highly reactive vapor such as $P_4O_6$ which is much easier to polarize than mercury vapor when in the influence of an electric field, cost less, and has fewer environmental hazards. Sodium, zinc, and calcium based compounds are also effective. With a different construction for the polarization electrode, a different construction for the power electrode, a different ion discharge chamber configuration, and the addition of a negative electrode to establish the electric field that separates the ions, the present invention is superior to the Phillips '361 patent in virtually every way.

The engine can generate enough power to lift an airplane or spacecraft off the earth's surface and propel it in any direction. As no external oxygen is necessary for the operation of this engine, it can operate outside the atmosphere for spacecraft in space.

SUMMARY

This is an ion engine which utilizes a form of ion propulsion to generate power from a material propellant. The propellant can be any compound or element that can be vaporized and have its nuclei charged in an electric field. Some compounds and elements are better than others at holding a positive charge on the nucleus of the component atoms. The preferred propellant is $P_4O_6$, a man made compound that becomes a highly reactive vapor at a reasonably low temperature.

Thrust is derived by the construction of an ion repulsion discharge chamber, and the placement of positive and negative conducting electrodes, which act upon a net positive charge of the nucleus or nuclei, within the propellant vapors. Propellant vapor is delivered to a propellant entry chamber.

The basic elements of the engine include a housing; an ion discharge chamber divided into a plurality of sections, each section disposed at an angle from the other sections and each section open at a bottom end, sufficient to allow the escape of a vaporized material and adapted to connect to a plurality of propellant entry chambers, three sections angled on a slope in three dimensional space are optimum; a plurality of propellant entry chambers in the housing each open at the end connected to the ion discharge chamber and adapted to receive entry of a vaporized material; a first positively charged electrode attached to the housing near the bottom end of the ion discharge chamber; a second positively charged electrode attached to the housing near the bottom end of the ion discharge chamber; a first negatively charged electrode attached to the housing between the first positively charged electrode and the bottom end of the ion discharge chamber; a second negatively charged electrode attached to the housing disposed relative to the second positively charged electrode such that the second negatively charged electrode is between the second negatively charged electrode and the bottom end of the ion discharge chamber; a third positively charged electrode attached to the housing near the area where the propellant entry chambers are adapted to receive the vaporized material; a third negatively charged electrode attached to the housing near the area where the propellant entry chambers are adapted to receive the vaporized material disposed close to the third positively charged electrode and with the third positively charged electrode between the third negatively charged electrode and each propellant entry chamber; a means to control the time at which the electrodes are energized and de-energized.

Briefly stated, a vaporized propellent material is metered and injected into a propellant entry chamber. The propellant can be stored in tanks in liquid or solid form and subsequently heated to vapor form or it can be stored in vapor form if desired. Pipes or tubes carry the pressurized propellant from the storage container to the propellant entry chamber. One or more valves may be used to regulate the flow of propellant. The propellant material flows from the propellant entry chamber to the ion discharge chamber. The propellant vapor is acted upon by a charged electric field that is termed a polarization field. Positive electrodes at the open end of the discharge chamber and a negative electrode behind the ion entry chamber create this polarization field. The polarization field causes the electrons of the atoms to separate from the nuclei creating positive charged ions and free negatively charged electrons. This polarization field also creates a separation between the net charge of the positive ions and the net charge of the negative electrons within the propellant vapor. The separation of the net charges is accomplished at a very fast rate of speed in a strong electric field. The separation physically moves the positive nuclei close to the negatively charged electrode at the propellant entry chamber.

The polarization field is then turned off by de-energizing the electrodes used to create it, and simultaneously another high voltage electric field is established by energizing the positively charged electrode on the end of the propellant entry chamber and the negative electrodes at the end of the ion discharge chamber which acts upon the net positive charge within the vapor. This field is termed the power field because it generates the thrust. The positively charged electrode is very close to the net positive charge of the nuclei of the propellant vapors, and repels the nuclei of the propellant vapors (positive ions) out of the open end of the ion discharge chamber at an extremely high velocity. The engine and anything attached to it is thrust in the opposite direction due to the equal and opposite reaction force generated, as the net positive charge of the ions, within the of the propellant vapor, are repelled. The power field is then turned off, more propellant is pumped into the ion entry chamber and the process is repeated. This can be done a number of times per second limited only by the amount of propellant available. It can be done as fast as the vapor valves can operate with pressurized vapor, as an electric field can be generated in a time span of $1\times10^{-17}$ seconds. Each time the polarization field is interrupted by turning it off and the power field established, a pulse of thrust is generated.

Additional elements include means to supply the vaporized material, means to power the electrodes, means to control the flow of the vaporized material, and a means to time the energerization of the electrodes. Pipes, valves, and manifolds may be used to supply the vaporized material to the propellant entry chambers; electric switches time activated provide a means to time the energization and de-energization of the electrodes such that the first and second positive electrodes and the third negative electrode are energized while the first and second negative electrodes and the third positive electrode are not energized. At specified times these electrodes are de-energized and the first and second negative electrodes and the third positive electrode are energized. Electrically powered valves may be used to regulate the flow of propellant into the propellant entry chambers. On off switches are used as a means to energize and de-energize the electrodes. Electric power may be provided by batteries.

This invention utilizes "Charles Coulombs Law" generating huge electro-static forces when electrical charges of the same "electrical sign" are in close proximity of each other. By electrically forcing the positive ions to a position very close to the unenergized positive electrode plate, the force generated when the positive electrode plate is energized, creating the positive electrical charge, is increased over the force that would be generated by not electrically forcing the positive ions into close proximity to the positive electrode plate.

The following formula by Charles Coulomb is utilized by my invention, and is very important to note the following in this formula: "R" represents the distance between the net positive charge of the vapors and the positive charge on the power electrode (both of the same electrical sign) and is located in the denominator of this formula. In my invention, by the use of a special polarization field inside the ion discharge chamber, it acts on the propellant vapors and locates the net positive charge of propellant vapors extremely close to the positively charged electrode. Therefore, in my invention, the "R" (distance) in Charles Coulombs force formula represents a very short distance when the vapors are repelled out of the chamber.

Also, noted by the use of mathematics in analyzing Charles Coulombs force formula, that as the "R" (distance) between these charges approach "Zero" (0), which is in the denominator of this formula, then the force generated by my engine approaches infinity. Charles Coulombs formula is as follows:

$$\text{Reaction Force} = \frac{[9\times10^{9}][Q_1][Q_2]}{R^2}\text{Newtons}$$

where:

$Q_1$=Net positive charge of the ions (coulombs)

$Q_2$=Positive charge on the (power) electrode (coulombs)

$R^2$=Distance (meter) between the net positive charge of vapors and the positive charge on the power electrode $[9\times10^{9}]$ =Constant involving the speed of light (squared)

Force=Newtons

The practical engine pulse rate is designed for the electrical fields to pulse at the rate of 1.5 times per second; however, fields can be pulsed at much faster rates or at slower rates if desired merely by regulating the time that the polarization field is turned off and on. Obviously, faster pulse rates of the vapors will generate greater thrust from the engine, since the time span between each pulse is a function of power.

One very important variant feature of this engine, which is different from the prior art, is the arrangement of the ion discharge-chambers into 3 groups. Where two or more, preferably three (3) sections are used, this allows it to produce a thrust force on the engine in any direction. See FIGS. 1, 2, and 3 for details of this arrangement. This allows the movement vector to be adjusted in any direction in three dimensional space.

DETAILED DESCRIPTION OF THE PREFERRED EMBODIMENTS

Figure 1:
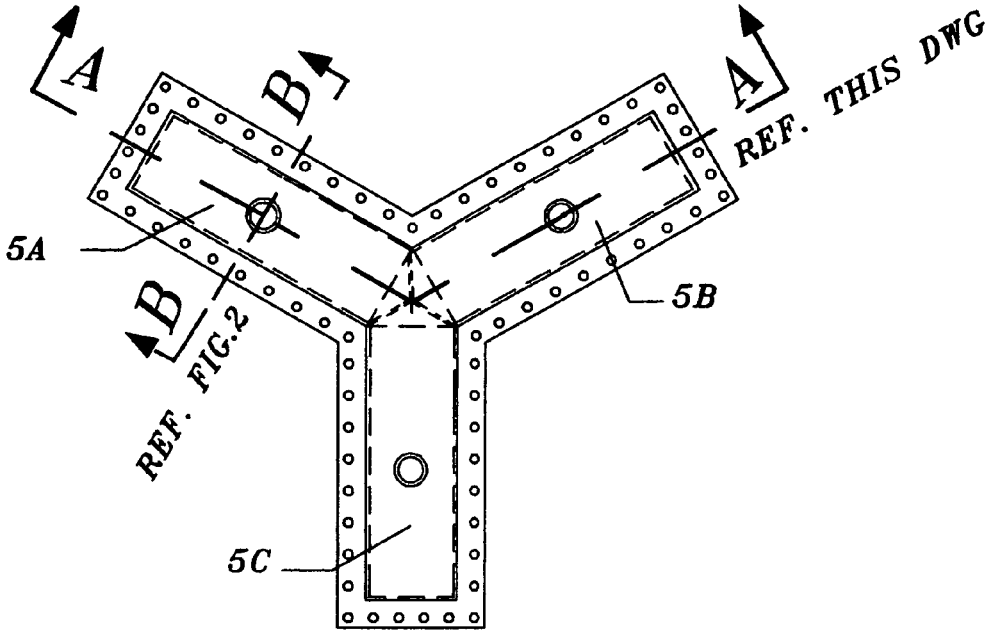
FIG. 1 is showing plan view of engine and Sec. A-A is showing the cross section of the electrodes within the ion repulsion discharge chamber.
Figure 1:
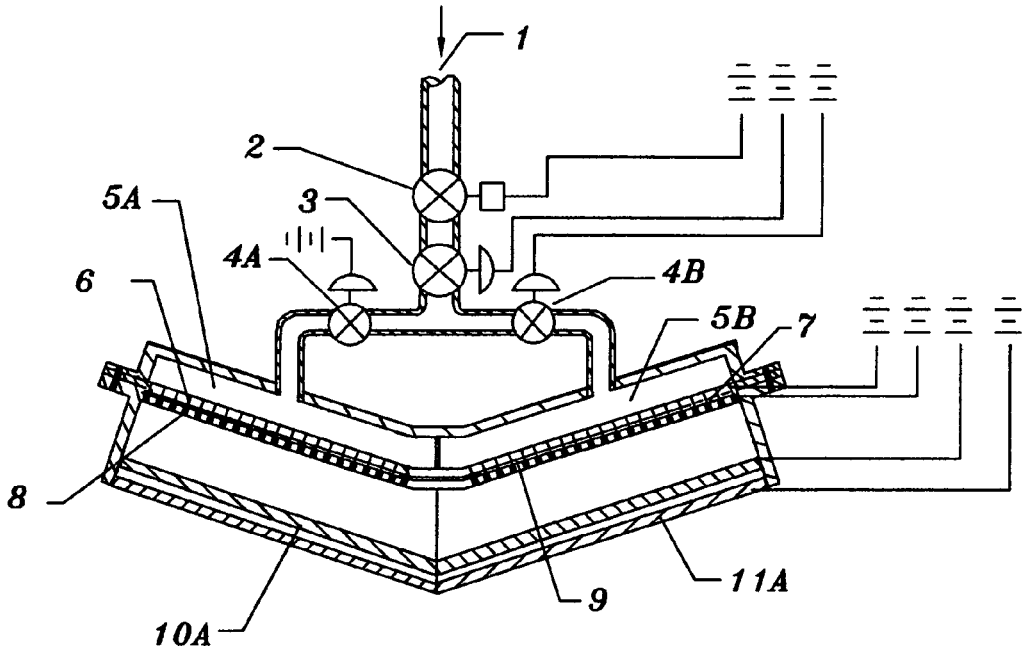
Figure 2:
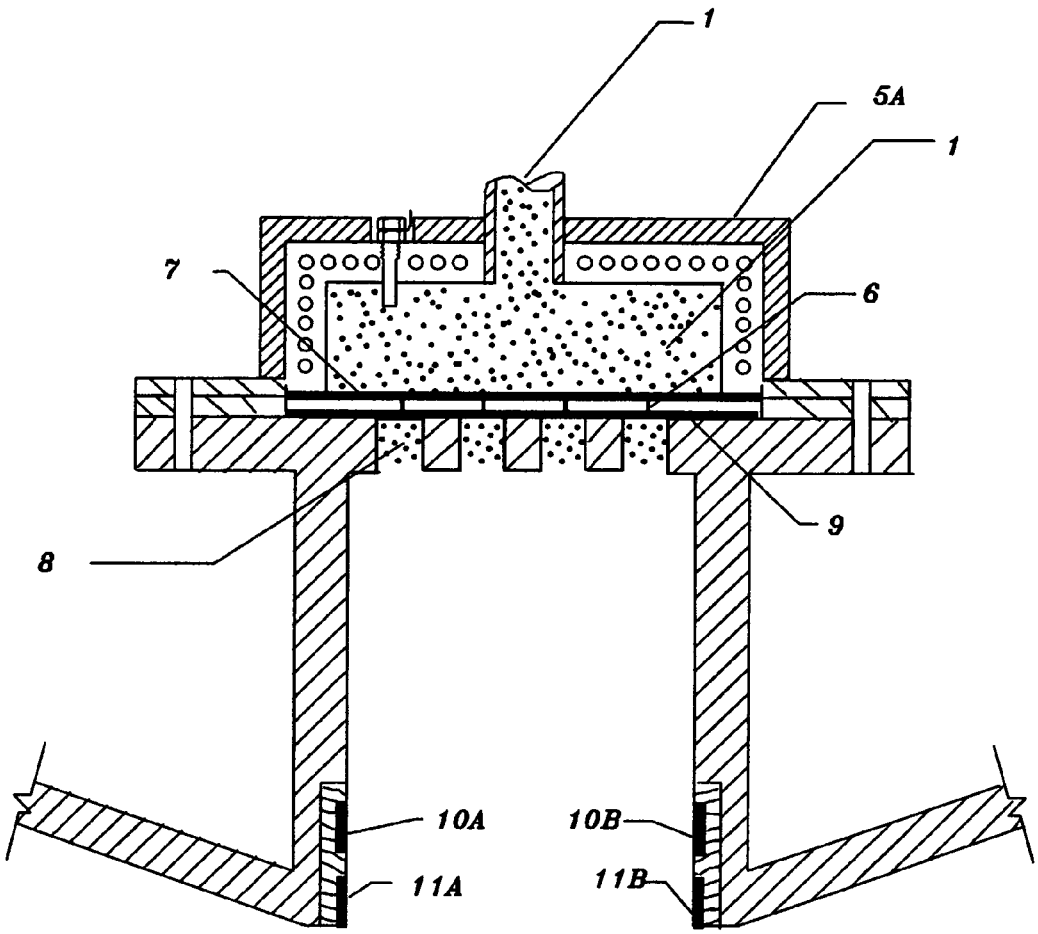
FIG. 2 is Section B-B showing the cross section of the ion repulsion discharge chamber.
Figure 3:
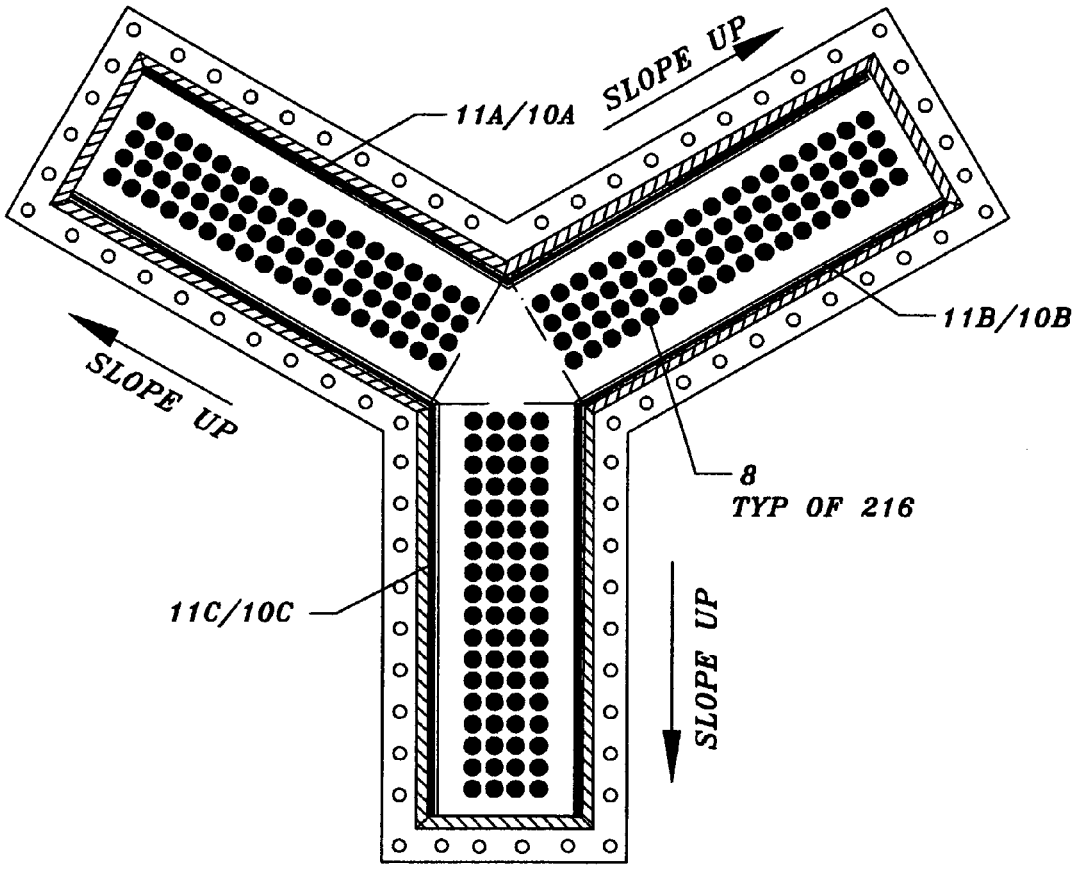
FIG. 3 is an enlarged view of the bottom of the engine.

The purpose of this engine is to produce power from a high temperature vapor of $P_4O_6$, phosphorus trioxide, and high voltage electricity. $P_4O_6$ is made from fertilizer and falls harmlessly to the earth, unlike combustion products, of rockets. $P_4O_6$ decomposes into other environmentally less hazardous products than chemical fuels, solid fuels, mercury or other propellants, consequently, use of $P_4O_6$ is both the most effective propellant and the least harmful.

Under normal conditions, $P_4O_6$ melts at 72.5 degree F. and flows from the propellant fuel tanks through solenoid (on-off) valves and then into the propellant vaporization chamber where it boils at 343 degrees F. and is transformed into a vapor. The vaporized $P_4O_6$ (1) then flows through the propellant system shut off valve (2), then flows through the propellent throttle flow control valve (3), then flows through any combination of the propellant directional valves (4*a*,4*b*,4*c*) which then flows into three propellant distribution-manifolds (5*a*,5*b*,5*c*). From the three propellant distribution manifold the vaporized $P_4O_6$ flows through small orifices (6) into 216 cylinders referred to as propellant entry chambers (8), each approximately 1 inch diameter×1 ½ inch deep, all located on the upper end of the ion discharge chamber.

The polarization field will be created by using three positively charged electrodes and three negatively charged electrodes. There will be a first positively charged electrode attached to the housing near the bottom end of the ion discharge chamber, a second positively charged electrode attached to the housing near the bottom end of the ion discharge chamber and directly opposite the first positively charged electrode, and a third positively charged electrode attached to the housing near the area where the propellant entry chambers are adapted to receive vaporized propellant. There will be a first negatively charged electrode attached to the housing between the first positively charged electrode and the bottom end of the ion discharge chamber, a second negatively charged electrode attached to the housing opposite the first negatively charged electrode near the bottom end of the ion discharge chamber and disposed relative to the second positively charged electrode such that the second negatively charged electrode is between the second positively charged electrode and the bottom end of the ion discharge chamber, and a third negatively charged electrode attached to the housing near the area where the propellant entry chambers are adapted to receive vaporized propellant disposed close to the third positively charged electrode and with the third positively charged electrode between the third negatively charged and each propellant entry chamber. The ion discharge chamber is adapted at the end near where the third positively charged electrode is attached to the housing connect to a plurality of propellant entry chambers. This will generate the polarization field necessary for the engine to function.

As the $P_4O_6$ vapors are filling the propellant entry chamber cylinders, a polarization field (12), is created by negatively charged electrode (7) and positively charged electrodes (10*a*, 10*b*, 10*c*) which positively polarizes the nucleus of the $P_4O_6$ vapors within the ion entry chamber cylinders. As this polarization takes place through the $P_4O_6$ vapors, it creates a separation of a net positive charge of positive ions from a net negative charge of the free electrons within the $P_4O_6$ vapors. The net charge of positive ions are forced upward toward the negatively charged electrode, and the net charge of the electrons are forced downward toward the positively charged electrode within the $P_4O_6$ vapors as opposite charges attract and same charges repel.

Also, during the energizing of the polarization field upon the $P_4O_6$ vapors, there are huge numbers of free mobile electrons (13) within the vapors that pulled away from the $P_4O_6$ total mass, and are expelled through the bottom of the ion discharge chamber. Due to the removal of these loosely connected electrons by the electrical force of polarization field, this creates an overall a high state of positive ionization of the $P_4O_6$ vapors.

To further discuss this process, the net positive charge within the $P_4O_6$ vapors, composed of the nuclei of the $P_4O_6$ vapors, are attracted upward toward the energized negatively charged polarization electrode (7), and are compressed against the de-energized power electrode (9) which is immediately in front of the negatively charged polarization electrode (7). The net negative charge of the $P_4O_6$ vapors, composed of the mobile free electrons, are attracted downward toward the energized positively charged polarization electrodes (10*a*,10*b*, 10*c*). Therefore, the function of the polarization field is to create a separation between the net positive charge of the nuclei of the $P_4O_6$ vapors, and the net negative charge of the mobile free electrons within the $P_4O_6$ vapors, while inside each of the cylinders (8) of the ion entry chamber cylinders and simultaneously force the positive charged nuclei of the vapor as close as physically possible to the unenergized power electrode (9). This reduces the R in the equation to as close to zero as practical.

An upward force (thrust) is generated by the engine when the polarization field (12) is de-energized (turned off), and immediately the positively charged power electrode (9) is energized while the net positive charge of the $P_4O_6$ vapors pressed very close to its surface. The $P_4O_6$ vapors are repelled away from the surface of the energized power electrode (9) with a tremendous velocity, and a huge reaction force is generated perpendicular to the surface of the power electrode (9). The direction opposite of the movement of the $P_4O_6$ nuclei.

The negative electrodes (11*a*,11*b*, 11*c*) of the power field (14) are located at the bottom of the ion discharge chamber which make up the negative pole of the power field (14).

Pipe 15 connects to manifold 5 to supply the vaporized material. The vaporized material 1 flows through pipe 15 into manifold 5 and through the small orifices 6 into the propellant entry chambers 8. Battery 16 supplies power to valves 2, 3, and 4. Battery 17 supplies power to the electrodes 7, 9, 10, and 11.

When the $P_4O_6$ vapors are discharged from the bottom of the ion discharge chamber, they recover most of the electrons and become electrically neutral, and therefore, will not be attracted back to the structure of the craft which would slow the craft down.

Figure 4:
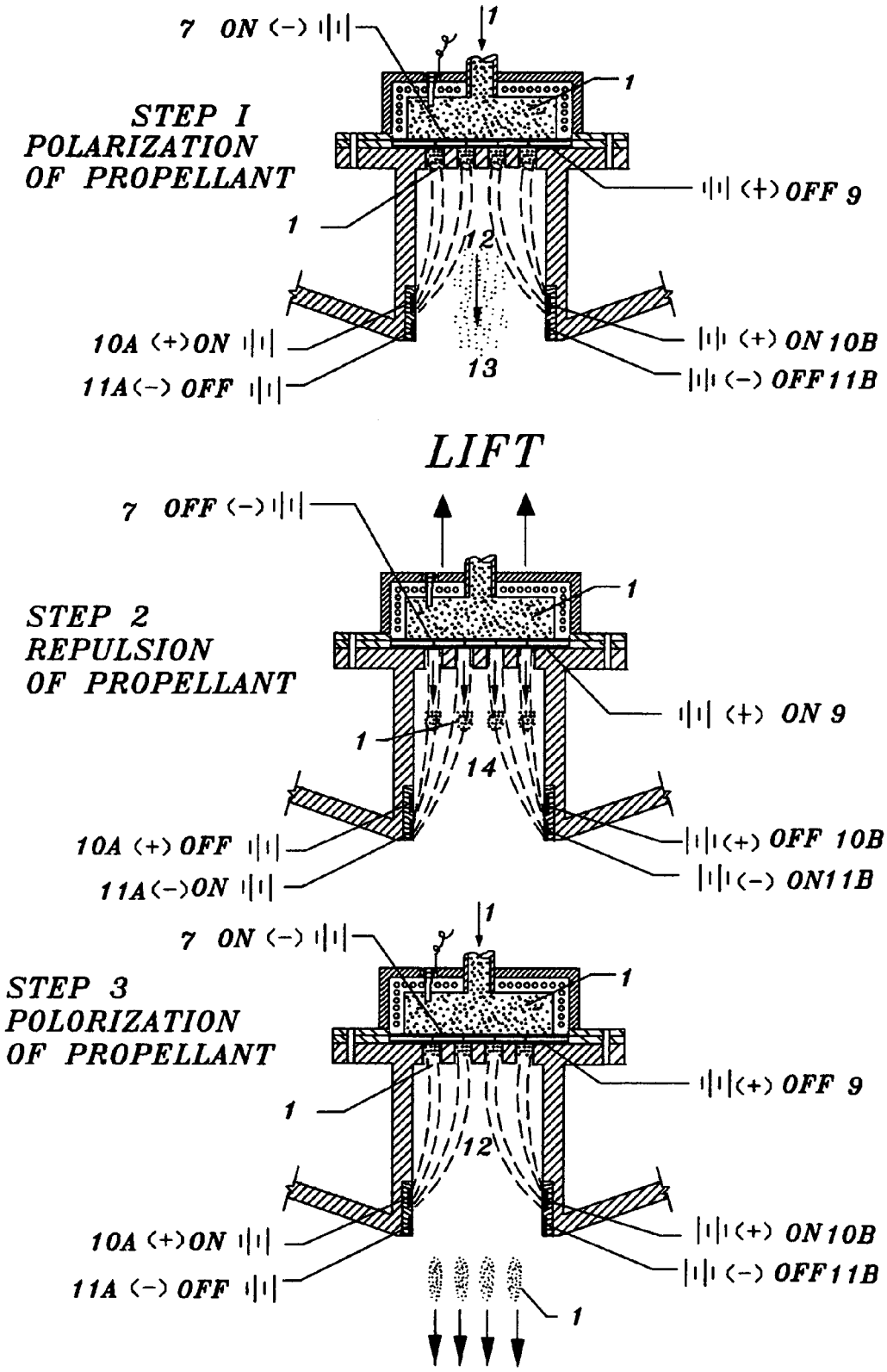
FIG. 4 is a diagrammatic process describing how lift is generated on the engine.

See FIG. 4 for diagrammatic process of this action.

Any method of providing high voltage electrical power necessary for the operation of this engine is permitted and acceptable. A time control to alternately energize the polarization field and the power field is necessary to regulate the thrust of the engine over a sustained time.

The directional control of the engine is controlled by the amount of propellant that is injected into each of the three (3) linear sections of the ion discharge chamber. When vapors are repelled out of each section of the ion discharge chamber it creates a reaction Force Vector which is perpendicular to the top surface of that section. The greater the mass of propellant that is repelled from a section, up to a point, the greater the Force Vector generated in that section. There are always three (3) separate Force Vectors acting on the power electrode (9) when the engine is in operation. The engine will always travel in the direction of the Resultant Force composed of the three (3) separate force vectors acting on the engine.

The invention claimed is:

1. An ion engine comprising:

a housing;

an ion discharge chamber divided into a plurality of sections, each section disposed at an angle from the other sections and each section open at a bottom end sufficient to allow the escape of a vaporized material and adapted to connect to a plurality of propellant entry chambers;

a plurality of propellant entry chambers in the housing each open at the end connected to the ion discharge chamber and adapted to receive entry of the vaporized material;

a first positively charged electrode attached to the housing near the bottom end of the ion discharge chamber;

a second positively charged electrode attached to the housing near the bottom end of the ion discharge chamber;

a first negatively charged electrode attached to the housing between the first positively charged electrode and the bottom end of the ion discharge chamber;

a second negatively charged electrode attached to the housing disposed relative to the second positively charged electrode such that the second negatively charged electrode is between the second negatively charged electrode and the bottom end of the ion discharge chamber;

a third positively charged electrode attached to the housing near the area where the propellant entry chambers are adapted to receive the vaporized material;

a third negatively charged electrode attached to the housing near the area where the propellant entry chambers are adapted to receive the vaporized material disposed with the third positively charged electrode between the third negatively charged electrode and each propellant entry chamber;

a means to energize the third negatively charged electrode; and the vaporized material consisting of $P_4O_6$.

2. An ion engine comprising;

a housing;

an ion discharge chamber, divided into three sections, each section angled on a slope relative to three dimensional space in the housing open at a bottom end sufficient to allow the escape of a vaporized material and adapted to connect to a plurality of propellant entry chambers;

a plurality of propellant entry chambers in the housing each open at the end connected to the ion discharge chamber and adapted to receive entry of the vaporized material;

a first positively charged electrode attached to the housing near the bottom end of the ion discharge chamber;

a second positively charged electrode attached to the housing near the bottom end of the ion discharge chamber;

a means to energize the first and second positively charged electrodes;

a first negatively charged electrode attached to the housing between the first positively charged electrode and the bottom end of the ion discharge chamber;

a second negatively charged electrode attached to the housing disposed relative to the second positively charged electrode such that the second negatively charged electrode is between the second negatively charged electrode and the bottom end of the ion discharge chamber;

a means to energize the first and second negatively charged electrodes;

a third positively charged electrode attached to the housing near the area where the propellant entry chambers are adapted to receive vaporized material;

a third negatively charged electrode disposed close to the second positively charged electrode and with the second positively charged electrode between the third negatively charged electrode and each propellant entry chamber;

a means to energize the third positively charged electrode;

a means to energize the third negatively charged electrode;

a means for supplying vaporized material into the ion entry chamber;

a propellant vaporized material composed of $P_4O_6$;

a means to regulate the flow of propellant into the propellant entry chambers; and a means to time the energization and de-energization of the electrodes such that the first and second positive electrodes and the third negative electrode are energized while the first and second negative electrodes and the third positive electrode are not energized and at specified times these electrodes are de-energized and the first and second negative electrodes and the third positive electrode are energized.

3. An ion engine comprising:

a housing;

an ion discharge chamber, divided into three sections, each section angled on a slope relative to three dimensional space in the housing open at a bottom end sufficient to allow the escape of a vaporized material and adapted to connect to a plurality of propellant entry chambers;

a plurality of propellant entry chambers in the housing each open at the end connected to the ion discharge chamber and adapted to receive entry of a vaporized material;

a first positively charged electrode attached to the housing near the bottom end of the ion discharge chamber;

a second positively charged electrode attached to the housing near the bottom end of the ion discharge chamber;

a means to energize the first and second positively charged electrodes;

a first negatively charged electrode attached to the housing between the first positively charged electrode and the bottom end of the ion discharge chamber;

a second negatively charged electrode attached to the housing disposed relative to the second positively charged electrode such that the second negatively discharged electrode is between the second negatively charged and the bottom end of the ion discharge chamber;

a battery to energize the first and second negatively charged electrodes;

a third negatively charged electrode disposed close to the third positively charged electrode and with the third positively charged electrode between the third negatively charged electrode and each propellant entry chamber;

a battery to energize the third positively charged electrode;

a battery to energize the third negatively charged electrode;

a pipe adapted to supply the vaporized material into the ion entry chamber;

a vaporized material composed of $P_4O_6$; and a valve connected to the pipe and adapted to regulate the flow of vaporized material into the propellant entry chambers.

4. An ion engine comprising:

a housing;

an ion discharge chamber, divided into three sections, each section angled on a slope relative to three dimensional space in the housing, open at a bottom end sufficient to allow the escape of a vaporized material and adapted to connect to a plurality of propellant entry chambers;

a plurality of one inch diameter and one and one half inch deep propellant entry chambers, each open at the end connected to the ion discharge chamber adapted to receive entry of the vaporized material with small orifices in the propellant entry chambers;

a first positively charged electrode attached to the housing near the bottom end of the ion discharge chamber;

a second positively charged electrode attached to the housing near the bottom end of the ion discharge chamber;

a battery to energize the first and second positively charged electrodes;

a first negatively charged electrode attached to the housing between the first positively charged electrode and the bottom end of the ion discharge chamber;

a second negatively charged electrode attached to the housing and disposed relative to the second positively charged electrode such that the second negatively charged electrode is between the second negatively charged and the bottom end of the ion discharge chamber;

a battery to energize the first and second negatively charged electrodes;

a third positively charged electrode attached to the housing near the area where the propellant entry chambers are adapted to receive the vaporized propellant;

a third negatively charged electrode disposed with the second positively charged electrode between the third negatively charged electrode and each propellant entry chamber;

a battery to energize the third positively charged electrode;

a battery to energize the third negatively charged electrode;

a pipe adapted to supply the vaporized material through the pipe;

a manifold attached to the housing connected to the pipe adapted to supply the vaporized material through the manifold and through the small orifices into the ion entry chamber; and the vaporized material composed of $P_4O_6$.

* * * * *